United States Patent [19]

Rundell et al.

[11] 4,379,556

[45] Apr. 12, 1983

[54] STRIPPING GLAND FOR MULTICABLES WITH CONNECTOR

[75] Inventors: Herbert A. Rundell, Houston; Eugene B. Horton, Jr., Bellaire, both of Tex.

[73] Assignee: Texaco Inc., White Plains, N.Y.

[21] Appl. No.: 388,354

[22] Filed: Jun. 14, 1982

[51] Int. Cl.[3] ..... E21B 33/08; F16J 15/56

[52] U.S. Cl. ..... 277/12; 277/102; 166/83; 166/84

[58] Field of Search ..... 166/84, 83, 82; 277/12, 277/102, 237 R

[56] References Cited

U.S. PATENT DOCUMENTS

| | | | |
|---|---|---|---|
| 129,129 | 7/1872 | Gretter | 166/84 |
| 1,762,211 | 6/1930 | Bradford | 277/208 |
| 2,578,669 | 12/1951 | Butterfield et al. | 166/84 |
| 4,060,249 | 11/1977 | Stowe et al. | 166/82 |
| 4,090,573 | 5/1978 | Rankin | 166/84 |
| 4,289,294 | 9/1981 | McLean | 277/102 |
| 4,327,586 | 5/1982 | Goddard | 277/12 |
| 4,345,766 | 8/1982 | Turanyi | 166/84 |

*Primary Examiner*—Robert I. Smith

*Attorney, Agent, or Firm*—Carl G. Ries; Robert A. Kulason; Henry C. Dearborn

[57] ABSTRACT

A stuffing box for a pressurized well where plural cables are attached end to end, and the connector has a larger diameter than either of the cables. The stuffing box structure is a combination that includes a housing for the connector and a packing gland for each of the cables. It has a latching holder that incorporates one of the glands, and a receptacle for holding the latching holder removably therein. The receptacle may be mounted at the well head, and it has the other packing gland removably attached to it. The latching holder has a seal that cooperates with the receptacle when the holder is inside. The whole arrangement permits retaining a pressure seal while moving the connector through the stuffing box in either direction.

13 Claims, 9 Drawing Figures

STRIPPING GLAND FOR MULTICABLES WITH CONNECTOR

BACKGROUND OF THE INVENTION

1. Field of the Invention

This invention concerns a particular stuffing box structure which is especially adapted for use with cables in a bore hole. It is applicable to cables that are connected end to end and have a connector which is larger in diameter than the cables.

2. Description of the Prior Art

While a stuffing box structure, per se, is of course old and well known, a problem arose in a situation which involved making surveys down a bore hole with a transducer. The requirements included a signal/power cable to the surface, and it required a pack-off gland at the top of the well for the cable. Such a pack-off gland was especially required if the bore hole was pressurized. Furthermore, the cable to be employed required different construction for the sections at the bottom and top ends thereof. Consequently, a connector was required to join the two ends of these different cables. Such a connector would have a larger diameter than the cables which would be joined thereby, and consequently, a problem of how to maintain the pressure seal was encountered. An example of the basis for the problem, relates to the retorting of oil shale, wherein the bottom of a bore hole is very hot and consequently, it requires a high temperature cable, while the top portion may use a lower temperature (easier-to-handle) cable. In that arrangement the cables may be a different size, and they are connected together with a connector having a size different from either of the cables.

Consequently, it is an object of this invention to provide a stuffing box structure which permits the use of multiple types of cable with a larger sized connector which can pass into or out of a bore hole while maintaining the pressure conditions therein.

Heretofore, there has been issued a U.S. Pat. to W. G. Bradford No. 1,762,211 issued June 10, 1930. However, that patent merely discloses an arrangement for having a packing head that will act as a stripper on the cable holding a down hole tool. The arrangement permits release of the stripper portion as the tool reaches the surface. The release arrangement is in the structure which holds the stripper head. This merely provides for the ability to remove the tool from the hole as it reaches the surface structure that holds the stripper. It is done by releasing the stripper from the holder thereof, as the tool is removed.

SUMMARY OF THE INVENTION

Briefly, the invention concerns a stripping gland for maintaining a pressure seal with multicables having a larger diameter connector joining pairs of said cables. It comprises in combination a packing gland for each of said cables, and a housing for said connector. It also comprises a latching holder for said housing, the said holder incorporates one of said packing glands. It also comprises a receptacle for said latching holder having another of said packing glands associated therewith.

Again briefly, the invention concerns a stuffing box for use at a well head in a down hole survey wherein a plurality of cables are employed and at least two are joined at an end of each by a connector having an outside diameter greater than said cables. It comprises in combination a housing for said connector to provide a predetermined size and to increase the tensile strength of said connector, and a packing gland for each of said cables. It also comprises a latching holder for said housing, the said holder incorporates one of said packing glands. It also comprises a receptacle for said latching holder and having another of said packing glands associated therewith, and means for mounting said receptacle at said well head to retain a difference of pressure between said well and the atmosphere outside.

Once more briefly, the invention concerns a stuffing box for use at a well head in a down hole survey wherein a plurality of cables are employed and at least two are joined at an end of each by a connector having an outside diameter greater than said cables. It comprises in combination a cylindrical housing for said connector to provide a predetermined size with square edges and to increase the tensile strength of said connector, and a packing gland for each of said cables. It also comprises a latching holder for said housing and incorporating one of said packing glands therein, and a receptacle for said latching holder and having another of said packing glands detachably associated therewith. It also comprises means for mounting said receptacle at said well head to retain pressure in said well. The said latching holder comprises an O-ring seal on the exterior of said holder for retaining said pressure at the interior of said receptacle when said holder is received therein, and a pair of pivoted latching arms for releasably latching said housing. The latching holder also comprises means for biasing said arms into latching position relative to said cylindrical housing, and first means for pivoting said arms against said bias to unlatch said housing when said latching holder is in said receptacle. And, the latching holder also comprises second means for pivoting said arms with said bias to hold said housing latched into said holder when both are out of said receptacle.

BRIEF DESCRIPTION OF THE DRAWINGS

The foregoing and other objects and benefits of the invention, will be more fully setforth below in connection with the best mode contemplated by the inventor of carrying out the invention, and in connection with which there are illustrations provided in the drawings, wherein.

Figure 8:
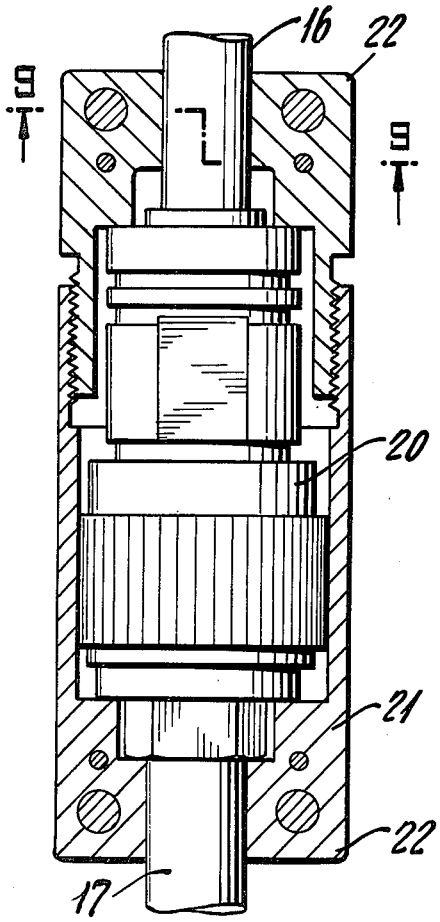
Figure 9:
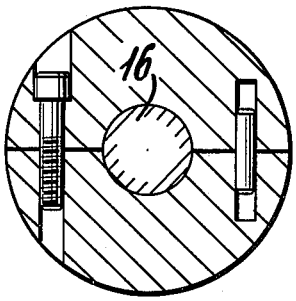

FIG. 8 is a somewhat more enlarged longitudinal cross-sectional view of a housing structure according to the invention, with a connector for the cables mounted therein; and FIG. 9 is a transverse cross-sectional view taken along the lines 9—9 of FIG. 8 and looking in the direction of the arrows.

DESCRIPTION OF THE PREFERRED EMBODIMENT

Figure 1:
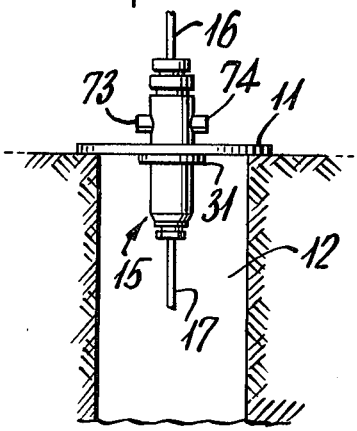
FIG. 1 is a schematic illustration of a stripping gland according to the invention, as it may be mounted at a well head structure.
Figure 2:
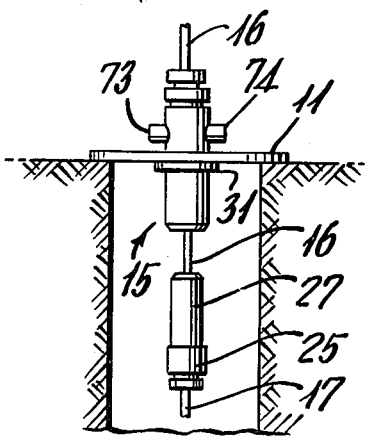
FIG. 2 is another schematic showing of a stuffing box according to the invention, like FIG. 1 but with the latching holder elements moved down below the receptacle portion of the stuffing box, and with the pressure seal maintained at the well head.

As illustrated in FIGS. 1 and 2, the structure according to this invention may be employed at a well head 11 that is schematically illustrated at the top of a bore hole 12. As indicated in these Figures, a stuffing box 15 may be mounted at the well head 11. It is employed for permitting the use of two cables 16 and 17 that may have different sizes, and that are connected together end to end by a connector 20 (FIG. 8). Connector 20 is not visable in FIG. 1, but is shown in an enlarged view in FIG. 8. It will be noted that the connector 20 has a larger outside diameter than either of the cables 16 or 17. And, as will appear hereafter the connector 20 is mounted in a housing 21 which has a predetermined size that is cylindrical in outside surface and has square edges 22.

Details of the stuffing box 15 are illustrated in FIGS. 3–7, and it will be observed that the housing 21 is shown situated inside of a latching holder 25 that incorporates a packing gland 26 near the lower end (as viewed in FIG. 3) of the holder 25. The upper end of the holder 25 is formed as a bifurcated hollow cylindrical portion 27 which has its interior sized to fit the housing 21 therein.

Figure 3:
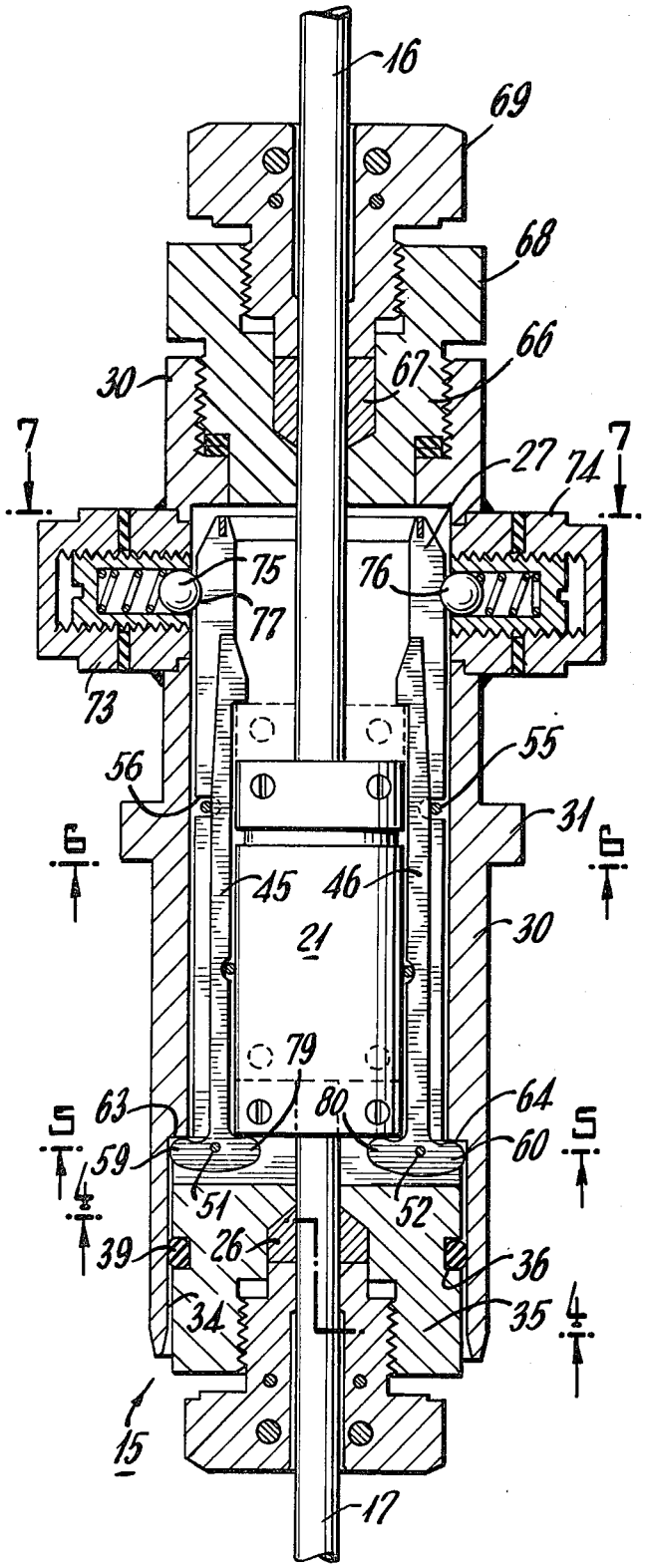
FIG. 3 is an enlarged longitudinal cross-section showing an assembly and illustrating a stripping gland combination according to the invention.
Figure 7:
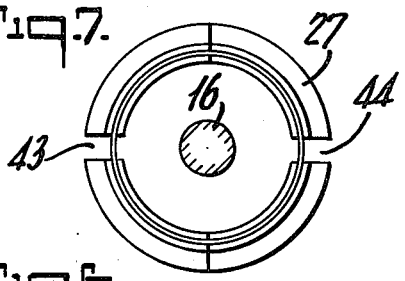
FIG. 7 is a transverse cross-sectional view of the interior elements taken along the lines 7—7 of FIG. 3 and looking in the opposite direction from FIGS. 4–6, as indicated by the arrows.
Figure 6:
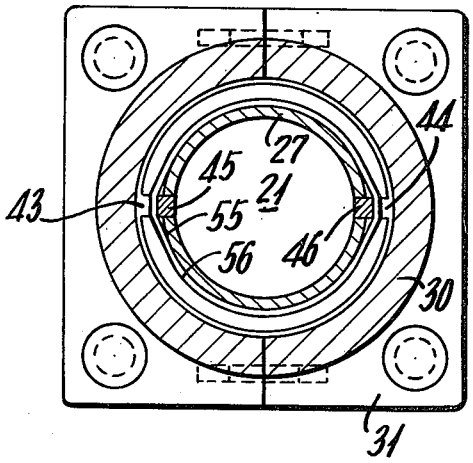
FIG. 6 is another transverse cross-sectional view taken along the lines 6—6 of FIG. 3 and looking in the direction of the arrows.
Figure 5:
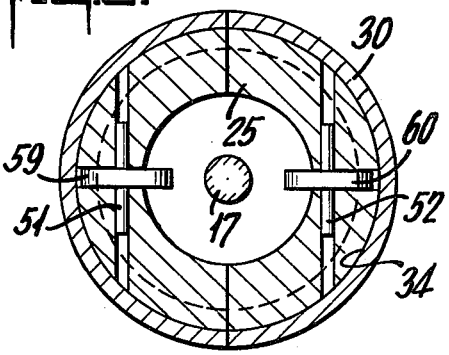
FIG. 5 is another transverse cross-sectional view taken along the lines 5—5 of FIG. 3 and looking in the direction of the arrows.
Figure 4:
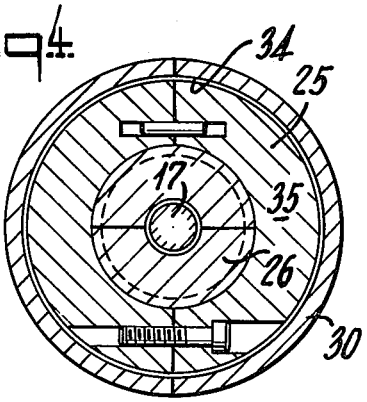
FIG. 4 is a transverse cross-sectional view taken along the lines 4—4 of FIG. 3 and looking in the direction of the arrows.

The outside of the stuffing box 15 forms a receptacle 30 that has a square flange 31 integrally formed therewith for mounting the receptacle 30 at the well head 11, as schematically indicated in FIGS. 1 and 2. The lower end of the receptacle 30 (as viewed in FIG. 3) has an enlarged inside diameter opening 34 which receives a base portion 35 of the latching holder 25, as indicated in FIG. 3. And, the base portion 35 has a groove 36 around the periphery thereof so as to accommodate an O-ring 39.

The bifurcated upper end 27 of the holder 25 has longitudinal slits 43 and 44 which accommodate a pair of latching arms 45 and 46 respectively. These latching arms 45 and 46 are pivoted near the lower end of each on pivot pins 51 and 52. The arms are biased into the latching position as illustrated in FIG. 3, by means of a light coil spring 55. The spring 55 is situated in a peripheral groove 56 in both halves of the bifuracated upper end 27 of latching holder 25. The arms 45 and 46 each have a crank means 59 and 60 respectively which extend radially outward from the pivot pints 51 and 52. These crank means 59 and 60 are transverse rocker shaped arms which are integral parts of the latching arms 45 and 46, and they are designed to come in contact with shoulders 63 and 64 respectively in each case. Shoulders 63 and 64 are formed at the upper end of the opening 34 in the receptacle 30 where it narrows to fit the connector housing 21.

There is another packing gland 67 that acts on the upper cable 16. This packing gland 67 is removably attached at the upper end of the receptacle 30, by being contained in a hex-headed socket 68 that has an exterior threaded body 66 which screws into the upper end of the receptacle 30. The inside of the hex-head of socket 68 is threaded to receive a packing screw 69 which cooperates with the socket 68 to compress the packing gland 67.

Above the flange 31 of the receptacle 30, there are a pair of detent lugs 73 and 74 which contain spring biased balls 75 and 76 in sockets therein, as clearly illustrated. The balls 75 and 76 act in conjunction with an exterior peripheral groove 77 located near the upper end of the bifurcated halves 27 of the holder 25.

It may be noted that there are additional crank means 79 and 80 which extend radially inward from the pivot pins 51 and 52 respectively. These cranks 79 and 80 are transverse rocker shaped arms integral with the latching arms 45 and 46 respectively, and they (crank 79 and 80) act to pivot the latching arms 45 and 46 inward when they contact the square edges 22 of the housing 21.

Operation

FIG. 3 illustrates the relative positions of the parts when the housing 21 with connector 20 therein, is situated in the bifurcated upper portion 27 of the latching holder 25, and the holder 25 is in position within the receptacle 30. If the cables 17 and 16 are pulled downward, the housing 21 will contact the inner crank extensions 79 and 80 of the arms 45 and 46. Consequently, the latching arms are urged radially inward about their pivot pins 51 and 52 (with the bias of the spring 55) and the housing 21 will remain latched into the hollow bifurcated portion 27 of the latching holder 25. Thereafter, the movement downward by the cables with the connector 20 inside of the housing 21 connected thereto, will carry the latching holder 25 and its upper end 27 (along with the housing 21 therein) down and out of the receptacle 30. The relative position of the elements then is as illustrated in FIG. 2.

In order to reach that position, the downward force exerted on the cable 17 is transmitted to the housing 21 and to the latching holder 25 so that it overcomes the holding force created by the balls 75 and 76 in groove 77 on the upper end 27 of the holder 25. Under those conditions i.e. when the latching holder 25 has moved out of the receptacle 30, a seal at the well head 11 is maintained by the upper packing gland 67 that is attached at the upper end of the receptacle 30, which in turn is attached to the well head 11 by its flange 31.

When the movement of the cables is reversed so cable 16 goes upward through the stuffing box 15, latching holder 25 with the housing 21 therein will move up until the upper end 27 goes into the receptacle 30. Then as it encounters sufficient resistance, the housing 21 will move a short distance up into the position indicated by dashed lines in FIG. 3 until it contacts the inward radial extensions near the upper ends of the latching arms 45 and 46. Then after everything has moved up in the receptacle 30 into the positions illustrated in FIG. 3, a further upward pull on the cable 16 will cause the latching holder 25 to move upward a distance limited by the space above the upper end 27. However, that distance is sufficient to have the crank portions 59 and 60 of the latching arms 45 and 46 (now in contact with the shoulders 63 and 64 near the lower end of the receptacle 30) to pivot the arms 45 and 46 about their pins 51 and 52 so as to move the arms radially outward at the upper ends thereof and so release the latching hold on the housing 21. That action takes place against the bias of the spring 55 which tends to hold the latching arms 45 and 46 radially inward.

After the unlatching has taken place, the housing 21 may then move on up vertically until it reaches the lower end of the threaded body 66 of the hex-headed socket 68 which contains the packing gland 67. Thereafter, the threaded portion 66 may be unscrewed to release it from the receptacle 30. And, the cables 16 and 17 may then continue upward carrying the housing 21 with connector 20 therein, on up above the well head. At such time, the well pressure is still contained by the lower packing gland 26 in contact with the cable 17, plus the seal created by O-ring 39 on the outside of the base 35 of the holder 25.

It will be noted from the foregoing that a pair of cables which may have different sizes if desired, and which include a connector that has a larger outside diameter than either cable, can be transferred into and out of a pressurized bore hole without loss of pressure during such transfer. Also, it may be noted that when the housing 21 and connector 20 are moved up above the well head and out of the receptacle structure of the stuffing box 15, the upper packing gland 67 will be carried with the upper cable 16 and remain above the housing 21. The well head seal is then maintained at the lower packing gland 26 plus the O-ring seal 39. On the other hand, as the housing 21 goes down hole below the well head, the seal at packing gland 67 will maintain the pressure since the threaded portion 66 of the socket 68 will then be reattached at the upper end of the receptacle 30. The whole latching holder unit 25 may then move down, having the housing 21 therein, and go with the cables on down the hole as far as desired.

While a particular embodiment of the invention has been described above in considerable detail in accordance with the applicable statutes, this is not to be taken as in any way limiting the invention but merely as being descriptive thereof.

We claim:

1. A stripping gland for maintaining a pressure seal with multicables having a larger diameter connector joining pairs of said cables, comprising in combination
- a packing gland for each of said cables,
- a housing for said connector;
- a latching holder for said housing,
- said holder incorporating one of said packing glands, and
- a receptacle for said latching holder having another of said packing glands associated therewith.

2. A stripping gland according to claim 1, also comprising
- means for mounting said receptacle for maintaining said seal at the exterior thereof.

3. A stripping gland according to claim 2, wherein
- said latching holder comprises seal means for maintaining said seal at the interior of said receptacle when received therein.

4. A stripping gland according to claim 3, wherein
- said latching holder also comprises means for releasably latching said housing therein.

5. A stripping gland according to claim 4, wherein
- said releasable latching means comprises a latching arm,
  - means for biasing said arm into latching position relative to said housing, and
  - means for moving said arm against said bias to unlatch said housing when said latching holder is in said receptacle.

6. A stripping gland according to claim 5, wherein
- said latching means also comprises
  - means for moving said arm with said bias to hold said housing in said holder when said holder and housing are out of said receptacle.

7. A stripping gland for maintaining a pressure seal with multicables having a larger diameter connector joining pairs of said cables, comprising in combination
- a packaging gland for each of said cables,
- a cylindrical housing for said connector,
- a latching holder for said housing,
- said holder incorporating one of said packing glands,
- a receptacle for receiving said latching holder therein and having another of said packing glands removably associated therewith, and
- means for mounting said receptacle for maintaining said seal at the exterior thereof,
- said latching holder comprising an O-ring seal on the exterior thereof for maintaining said seal with the interior of said receptacle when received therein, and
- means for releasably latching said housing in said latching holder,
- said releasable latching means comprises
- a pair of latching arms,
- means for pivoting said arms for movement into and out of latching position relative to said housing,
- means for biasing said arms into said latching position,
- first crank means on said arms for contacting said receptacle to pivot said arms against said bias to unlatch said housing, and
- second crank means on said arms for contacting said housing to pivot said arms with said bias to hold said housing in said holder when said holder and housing are out of said receptacle.

8. A stuffing box for use at a well head in a down hole survey wherein a plurality of cables are employed and at least two are joined at an end of each by a connector having an outside diameter greater than said cables, comprising in combination
- a housing for said connector to provide a predetermined size and to increase the tensile strength of said connector,
- a packing gland for each of said cables,
- a latching holder for said housing,
- said holder incorporating one of said packing glands,
- a receptacle for said latching holder and having another of said packing glands associated therewith, and
- means for mounting said receptacle at said well head to retain a difference of pressure between said well and the atmosphere outside.

9. A stuffing box according to claim 8, wherein
- said latching holder comprises seal means for maintaining said difference of pressure at the interior of said receptacle when received therein.

10. A stuffing box according to claim 9, wherein
- said latching holder also comprises means for releasably latching said housing therein.

11. A stuffing box according to claim 10, wherein
- said releasable latching means comprises at least one latching arm,
  - means for biasing said arm into latching position relative to said housing, and
  - means for moving said arm against said bias to unlatch said housing when said latching holder is in said receptacle.

12. A stuffing box according to claim 11, wherein
- said latching means also comprises means for moving said arm with said bias to hold said housing in said holder when said holder and housing are out of said receptacle.

13. A stuffing box for use at a well head in a down hole survey wherein a plurality of cables are employed and at least two are joined at an end of each by a connector having an outside diameter greater than said cables, comprising in combination a cylindrical housing for said connector to provide a predetermined size with square edges and to increase the tensile strength of said connector, a packing gland for each of said cables, a latching holder for said housing and incorporating one of said packing glands therein, a receptacle for said latching holder and having another of said packing glands detachably associated therewith, and means for mounting said receptacle at said well head to retain pressure in said well, said latching holder comprising an O-ring seal on the exterior of said holder for retaining said pressure at the interior of said receptacle when said holder is received therein, a pair of pivoted latching arms for releasably latching said housing, means for biasing said arms into latching position relative to said cylindrical housing, first means for pivoting said arms against said bias to unlatch said housing when said latching holder is in said receptacle, and second means for pivoting said arms with said bias to hold said housing latched into said holder when both are out of said receptacle.

* * * * *